US006319360B1

(12) United States Patent
Small et al.

(10) Patent No.: US 6,319,360 B1
(45) Date of Patent: Nov. 20, 2001

(54) PRODUCTION FOR MOTTLED PAPER

(75) Inventors: Edward Charles Small, Aberdeen; Ian Harper MacMaster, Aberdeenshire, both of (GB)

(73) Assignee: Arjo Wiggins Fine Papers Limited (GB)

( * ) Notice: Subject to any disclaimer, the term of this patent is extended or adjusted under 35 U.S.C. 154(b) by 0 days.

(21) Appl. No.: 09/530,104

(22) PCT Filed: Oct. 20, 1998

(86) PCT No.: PCT/GB98/03123

§ 371 Date: Apr. 25, 2000

§ 102(e) Date: Apr. 25, 2000

(87) PCT Pub. No.: WO99/22068

PCT Pub. Date: May 6, 1999

(30) Foreign Application Priority Data

Oct. 25, 1997 (GB) ..... 9722514

(51) Int. Cl.[7] ..... D21H 21/28

(52) U.S. Cl. ..... 162/134; 162/162; 162/183

(58) Field of Search ..... 162/135, 162, 162/183

(56) References Cited

U.S. PATENT DOCUMENTS

| | | | | |
|---|---|---|---|---|
| 1,281,951 | * | 10/1918 | Harper . | |
| 1,623,620 | | 4/1927 | Dodman, Jr. . | |
| 2,905,583 | * | 9/1959 | Feigley et al. | 162/134 |
| 3,562,098 | | 2/1971 | Plumez et al. . | |
| 4,444,959 | * | 4/1984 | Frey et al. . | |
| 4,543,157 | * | 9/1985 | Jones et al. . | |
| 5,690,789 | * | 11/1997 | Small et al. | 162/134 |
| 5,916,416 | * | 6/1999 | Fedrigoni et al. | 162/162 |

FOREIGN PATENT DOCUMENTS

| | | | |
|---|---|---|---|
| 340 574 | | 4/1927 | (BE) . |
| 1546280 | * | 2/1970 | (DE) . |
| 3024394 | * | 1/1982 | (DE) . |
| 3406808 | * | 9/1985 | (DE) . |
| 241162 | * | 11/1926 | (GB) . |
| 247964 | * | 11/1926 | (GB) . |
| 331707 | * | 7/1930 | (GB) . |
| 341 621 | | 1/1931 | (GB) . |
| 426303 | * | 4/1935 | (GB) . |
| 696673 | * | 9/1953 | (GB) . |
| 812697 | * | 4/1959 | (GB) . |
| 2043732 | * | 10/1980 | (GB) . |
| 47012003 | * | 4/1972 | (JP) . |
| 76003806 | * | 2/1976 | (JP) . |
| 61041398 | * | 2/1986 | (JP) . |
| 63309693 | * | 12/1988 | (JP) . |
| 4257396 | * | 9/1992 | (JP) . |
| 7279100 | * | 10/1995 | (JP) . |
| 8074199 | * | 3/1996 | (JP) . |

OTHER PUBLICATIONS

Anon, "Paper Colouring Methods and Equipment", Apr. 1989, p. 85.*

Patent Abstracts of Japan, JP 2 1458899 A, 14(390), Aug. 23, 1990.

* cited by examiner

*Primary Examiner*—Peter Chin
(74) *Attorney, Agent, or Firm*—Burns, Doane, Swecker & Mathis, LLP

(57) ABSTRACT

A method of producing a two-color mottle-effect patterned paper comprises the steps of coloring a papermaking stock by means of a first dye formulation, draining the resulting colored stock through a papermaking wire to produce a dyed wet paper web, subjecting the web to pressure, applying a second dye formulation to the paper web, said second dye formulation being of a different hue from the first dye formulation, and drying the web. The web is preferably subjected to pressure by passage through a smoothing press nip before passing to the drying section of the papermachine. The smoothing press can be one of the presses of the press section of the papermachine, run in unfelted mode. The second dye formulation is preferably applied at the papermachine size press or by spraying.

10 Claims, 1 Drawing Sheet

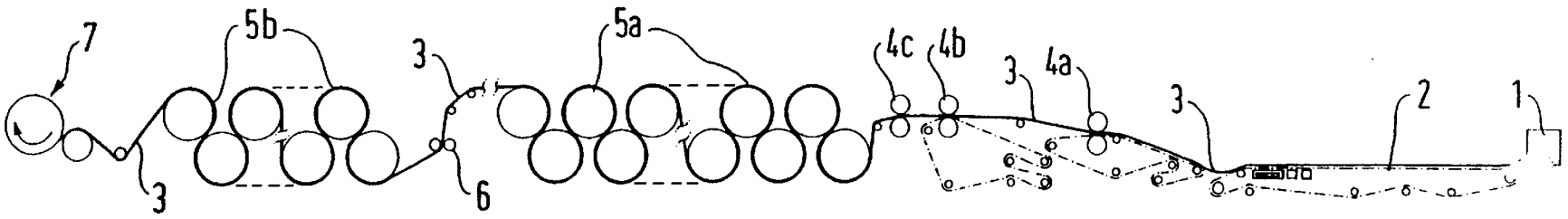
1
2
3
4a
3
4b
4c
5a
3
6
5b
3
7

PRODUCTION FOR MOTTLED PAPER

This invention relates to the production, on the paper machine, of paper which is patterned by means of a dye rather than by the use of printing techniques. By "patterned" is meant a paper which has been dyed non-uniformly rather than evenly over its whole surface. Patterned papers of this general kind are commercially available from Arjo Wiggins Fine Papers Limited under the trade mark STRATAKOLOUR and are typically used when it is desired to impart distinctive aesthetic appeal to products such as brochures, folders, menus, invitations, and stationery. Although the paper is patterned during its production on the paper machine, it can be overprinted if desired to give additional decorative effects.

Conventional patterned papers of the kind just described are produced by modification of the papermaking operation so as deliberately to produce a more uneven formation than is usual and by adding a dye at the papermachine size press (the papermaking stock itself is not dyed). A mottled effect results. This is due, at least in part, to the formation of fibrous lumps, i.e. clumps of fibres which disturb the homogeneity of the sheet. Such lump formation is considered undesirable in most types of paper and measures are taken to minimise it, for example by lateral shaking of the papermachine wire and appropriate choice of reflux ratio, i.e. the ratio of the speed of flow of the papermaking stock from the papermachine headbox on to the wire relative to the speed of the wire itself. However in the production of patterned papers of the kind under discussion, lump formation is deliberately encouraged by disengagement of the wire-shake mechanism, lowering the efflux ratio and increasing the proportion of long-fibre softwood pulp in the papermaking stock.

A conventional patterned paper produced as described above has white or light coloured mottling against a single colour dyed background. The mottled effect is the result of the dye having been ineffective in some areas of the paper. Such patterned paper products have proved popular and have enjoyed substantial sales, but there is always scope for fresh and attractive patterns and/or colour combinations. We therefore set ourselves the objective of producing mottle-effect patterned paper products of the same general kind as described above but in which two different colours are present, rather than one (the underlying hue of any undyed or incompletely-dyed fibre is not regarded as a "colour" in this context). Whereas conventional products have a single colour background against which undyed or incompletely-dyed fibrous regions stand out, we wished to produce a product having a dyed background and contrasting colour dyed areas which stand out against this background.

Our initial attempts to produce a two-colour mottle-effect patterned paper as just described involved colouring the papermaking stock (prior to web formation) with a first dye, forming the paper web, and then applying a second differently-coloured dye at the size press. However we found that either a two-colour effect was not obtained (as a result of the two colours merging) or the aesthetic effect obtained was not what was desired, for example in that a sufficiently sharp and clear distinction between the two colours was not achieved in the final product.

We have now found that this problem can be overcome by subjecting the initially-dyed web to pressure after it has been produced on the papermachine wire and before a second dye formulation is added. The effect of the pressure appears to be to compact the fibrous lumps in the web and thereby to close up their surface pore structure. This appears to prevent or at least inhibit penetration of the size press dye formulation into the compacted region. As a result, the lumps largely retain their initial dyed colour after application of the second dye formulation. By contrast, the "valleys" between the lumps are less compacted, and their more open surface pore structure permits penetration by the second dye formulation. The result is a colour contrast between the lumps, which have a colour derived from the first dye formulation, and the regions between the lumps, which have a colour derived partly from the first dye formulation and partly from the second dye formulation.

Accordingly, the present invention provides, in a first aspect, a method of producing a two-colour mottle-effect patterned paper, said method comprising the steps of:

(a) colouring a papermaking stock by means of a first dye formulation;

(b) draining the resulting coloured stock through a papermaking wire to produce a dyed wet paper web;

(c) subjecting the web to pressure;

(d) applying a second dye formulation to the paper web, said second dye formulation being of a different hue from the first dye formulation; and (e) drying the web.

In a second aspect, the present invention provides a two-colour mottle-effect patterned paper web produced by a process according to the first aspect of the invention.

In a third aspect, the present invention provides a two-colour mottle-effect patterned paper incorporating compacted fibrous lumps which have been dyed to a different hue from that of the remainder of the web.

Preferably, the paper web is produced with an enhanced fibrous lump content. This can be achieved in the conventional manner described earlier, i.e. by dispensing with papermachine wire shake, appropriate adjustment of the efflux ratio (for example within the range 0.7 or 0.8 to about 1) and/or use of a high proportion of long fibre softwood pulp in the papermaking stock (typically at least 40 to 45% softwood on a dry weight basis). However, it will be appreciated that all paper inevitably contains a certain proportion of fibrous lumps, and that the present method will give rise to a degree of patterning even if no special measures are taken to increase the proportion of fibrous lumps. Thus although the present invention preferably utilises a paper produced in such a manner as to maximise or enhance lump formation, an increased lump formation paper is not an essential feature of the invention.

The first and second dye formulations may each be based on a single dye or on a blend of dyes which together produce a desired final hue. The second dye formulation is preferably applied at the papermachine size press, but it could be applied by spraying or other means.

The web is preferably subjected to pressure by passage through a smoothing press nip before passing to the drying section of the papermachine. Alternatively, or in addition, the web may be calendered after it has been partially dried but before the second dye formulation is applied. Where a smoothing press is employed, it can conveniently be constituted by one of the presses of the press section of the papermachine, run in unfelted mode.

BRIEF DESCRIPTION OF THE DRAWING

In order to enable the invention to be more readily understood, reference will now be made to the FIGURE, which is a schematic side view of a papermachine suitable for production of the present patterned paper.

DESCRIPTION OF THE INVENTION

Referring now to the drawing, papermaking stock dyed by means of a first dye formulation is discharged from a headbox 1 on to a Fourdrinier wire 2. The pulps used in the stock and the efflux ratio used are selected so as to enhance fibrous lump formation. The mechanism normally used for laterally shaking the wire 2 is disengaged, again to enhance lump formation (this mechanism is not shown). The initially-wet web 3 formed on the wire 2 is drawn through the press section of the papermachine. The press section comprises first and second felted presses 4*a* and 4*b* respectively, followed by an unfelted smoothing press 4*c*. The smoothing press is adjusted so as to subject the wet web to pressure and compact fibrous lumps therein, with the result that their surface pore structure is closed up. The thus-treated web then passes to the dryer section 5 of the papermachine and thence to a reel-up station 7. The dryer section is divided into a main bank of drying cylinders 5*a* and an after-bank of drying cylinders 5*b* (only some of the cylinders in each bank are shown). A size press 6 is positioned between the main and after-banks of drying cylinders, and is arranged to apply a second dye formulation to the paper web.

A calender (not shown) positioned immediately before the size press may be used to compact the web instead of the smoothing press. A spraying station (also not shown) may be used to apply the second dye formulation, instead of the size press.

If it is desired to make heavyweight paper or board products a twin wire papermachine may be used, with the two plies being married together just prior to the first press of the press section to produce the heavyweight product.

The invention will now be illustrated by the following Examples, in which all parts and percentages are by weight unless otherwise specified.

A series of makings of two colour mottle-effect patterned paper was carried out as described above with reference to the drawing, except that the paper was a heavyweight (250 g $m^{-2}$) grade produced using a twin-wire Fourdrinier papermachine, the individual paper plies from which were married together as described above. The paper was produced without wire shake at an efflux ratio of 0.7 to 0.8, and had a softwood pulp content of about 45%, the residue being hardwood pulp. The smoothing press pressure was about 138 kPa (20 psi). The combinations of first (stock) and second (size press) aqueous dye formulations used are shown in Table 1 below, together with a description of the paper products obtained.

TABLE 1

| Example No. | Dye(s) used in first (stock) formulation | Dye(s) used in second (size press) formulation | Appearance of paper product |
|---|---|---|---|
| 1 | Yellow | Blue (low concentration) | Blue-green mottle on yellow background |
| 2 | Yellow | Blue | As above, but more bluish and pronounced mottle |
| 3 | Yellow<br>Blue<br>Red (trace) | Violet<br>Red<br>(minor amount) | Mauve mottle on green background |
| 4 | Orange | Violet | Violet mottle on pinkish background |

TABLE 1-continued

| Example No. | Dye(s) used in first (stock) formulation | Dye(s) used in second (size press) formulation | Appearance of paper product |
|---|---|---|---|
| 5 | Orange | Violet<br>Red<br>Blue | Maroon mottle on red background |
| 6 | Violet | Yellow<br>Red<br>(minor amount) | Orange mottle on mauve background |
| 7 | Violet<br>(low concentration) | Yellow<br>Red<br>(minor amount) | Orange mottle on very pale mauve background |

What is claimed is:

1. A method of producing a two-color mottle effect patterned paper, said method comprising the steps of:

(a) coloring a papermaking stock by means of a first dye formulation;

(b) forming fibrous lumps and producing a dyed wet paper web which contains said fibrous lumps by draining the resulting colored stock through a papermaking wire;

(c) compacting the fibrous lumps by subjecting the web to pressure;

(d) applying a second dye formulation to the paper web, said second dye formulation being of a different hue from the first dye formulation; and (e) drying the web.

2. A method as claimed in claim 1, wherein the wet web is subjected to pressure by passage through a smoothing press nip before passing to the drying section of the papermachine.

3. A method as claimed in claim 2, wherein the smoothing press is one of the presses of the press section of the papermachine, run in unfelted mode.

4. A method as claimed in claim 1, wherein the web is calendered after it has been partially dried but before the second dye formulation is applied.

5. A method as claimed in claim 1, wherein the second dye formulation is applied at the papermachine size press.

6. A method as claimed in claim 1, wherein the second dye formulation is applied by spraying.

7. A method as claimed in claim 1, wherein the papermaking wire is not laterally shaken as the stock is drained to produce the wet paper web, so as to encourage formation of fibrous lumps.

8. A method as claimed in claim 1, wherein an efflux ratio within the range 0.7 to 1 is employed to encourage formation of fibrous lumps.

9. A method as claimed in claim 1, wherein the papermaking stock comprises at least 40 to 45% long fiber softwood pulp on a dry weight basis, so as to encourage formation of fibrous lumps.

10. A method as claimed in claim 1, wherein an efflux ratio within the range of 0.8 to 1 is employed to encourage formation of fibrous lumps.

* * * * *